US009145712B1

(12) United States Patent
Tien

(10) Patent No.: US 9,145,712 B1
(45) Date of Patent: Sep. 29, 2015

(54) LOCK CYLINDER FOR A DOOR LOCK

(71) Applicant: I-TEK METAL MFG. CO., LTD, Tainan (TW)

(72) Inventor: Hung-Jen Tien, Tainan (TW)

(73) Assignee: I-Tek Metal Mfg. Co., Ltd., Tainan (TW)

( * ) Notice: Subject to any disclaimer, the term of this patent is extended or adjusted under 35 U.S.C. 154(b) by 0 days.

(21) Appl. No.: 14/572,912

(22) Filed: Dec. 17, 2014

(51) Int. Cl.
*E05B 13/00* (2006.01)
*E05B 27/00* (2006.01)
*E05B 17/04* (2006.01)

(52) U.S. Cl.
CPC ..... *E05B 27/0003* (2013.01); *E05B 13/005* (2013.01); *E05B 17/04* (2013.01); *Y10T 70/5792* (2015.04)

(58) Field of Classification Search
CPC ..... E05B 17/04; E05B 13/005; E05B 13/00; E05B 13/002; E05B 13/101; E05B 81/16; E05B 85/18; Y10T 70/5832; Y10T 70/5761; Y10T 70/7073; Y10T 70/5341; Y10T 70/5792; Y10T 70/7136; Y10T 70/5469
USPC ..... 70/207–210, 215–217, 224, 379 R, 380; 292/336.3
See application file for complete search history.

(56) References Cited

U.S. PATENT DOCUMENTS 2,976,714 A * 3/1961 Hofgesang ..... 70/63
3,044,815 A * 7/1962 Soss ..... 292/173
4,510,779 A * 4/1985 Ahad ..... 70/208
4,546,628 A * 10/1985 Takasaki ..... 70/92
5,457,971 A * 10/1995 Yamada ..... 70/208
5,469,725 A * 11/1995 Yamada ..... 70/208
6,023,953 A * 2/2000 Vickers et al. ..... 70/208
6,234,041 B1 * 5/2001 Larabet et al. ..... 74/523
6,234,548 B1 * 5/2001 Mittelbach et al. ..... 292/336.3
6,502,872 B1 * 1/2003 Molzer ..... 292/336.3
6,588,813 B1 * 7/2003 Marcarini et al. ..... 292/347
6,834,901 B2 * 12/2004 Low ..... 296/1.02
7,146,832 B2 * 12/2006 Mathofer ..... 70/208
7,603,881 B2 * 10/2009 Yukihara et al. ..... 70/208
7,819,440 B2 * 10/2010 Schwickerath ..... 292/201
8,029,032 B1 * 10/2011 Yang ..... 292/336.3
8,104,314 B2 * 1/2012 Mueller et al. ..... 70/370
8,562,039 B2 * 10/2013 Ichikawa et al. ..... 292/336.3
8,746,758 B2 * 6/2014 Savant et al. ..... 292/336.3
8,864,191 B2 * 10/2014 Muller et al. ..... 292/336.3
8,959,964 B2 * 2/2015 Hidaka et al. ..... 70/208
2002/0124606 A1 * 9/2002 Muneta ..... 70/208
2004/0011091 A1 * 1/2004 Zeuschner ..... 70/19
2004/0129040 A1 * 7/2004 Mathofer et al. ..... 70/208
2005/0115289 A1 * 6/2005 Talukdar et al. ..... 70/208
2005/0279144 A1 * 12/2005 Kutschat ..... 70/210
2006/0021400 A1 * 2/2006 Jackson ..... 70/210

* cited by examiner

*Primary Examiner* — Suzanne Barrett
(74) *Attorney, Agent, or Firm* — Alan D. Kamrath; Kamrath IP Lawfirm, P.A.

(57) ABSTRACT

A lock cylinder is mounted to an outer operating device of a door lock. The lock cylinder includes a lock core and an actuating block fixed to the lock core. The actuating block includes first and second lugs operatively coupled with the outer operating device. A key can be inserted into the lock core to pivot the lock core between an initial position and a non-initial position. When the lock core is in the non-initial position, the first lug permits a latch of the outer operating device to be moved from a latching position to an unlatching position by operating the outer operating device. When the lock core is in the initial position, the second lug prevents the latch from being moved from the latching position to the unlatching position by operating the outer operating device.

4 Claims, 15 Drawing Sheets

LOCK CYLINDER FOR A DOOR LOCK

BACKGROUND OF THE INVENTION

The present invention relates to a lock cylinder for a door lock and, more particularly, to a lock cylinder mounted to an outer operating device of a door lock to permit or not permit the outer operating device to unlatch a latch of the door lock.

Door locks have various types according to conditions, situations, and needs. Many of the door locks generally include an outer operating device mounted to an outer side of a door and operatively connected to a latch of the door lock. Operation of a handle of the outer operating device can retract the latch from a latching position to an unlatching position. The outer operating device generally includes a lock cylinder that can be operated to control the outer operating device to be in a locking state or an unlocking state. When the outer operating device is in the locking state, the latch cannot be unlatched by operation of the handle unless a key is inserted into a lock core in the lock cylinder to unlock the outer operating device.

However, whether the outer operating device is in the locking or unlocking state, the key can be separated from the lock core of the lock cylinder if the lock core is in its initial position. Furthermore, the lock core can be rotated to the initial position whether the outer operating device is in the locking or unlocking state. Namely, the key can be separated from the lock core even if a user forgets to lock the outer operating device. Thus, the user may forget to lock the outer operating device, or the user has to operate the handle of the outer operating device to make sure whether the outer operating device is locked.

BRIEF SUMMARY OF THE INVENTION

The present invention solves this need and other problems in the field of reliable locking of an outer operating device of a door lock by providing a lock cylinder for a door lock. The lock cylinder includes a cylinder body having a lock core hole. A lock core is pivotably received in the lock core hole. The lock core includes a head and a tail. The lock core further includes a keyway defined in the head. The tail is located outside of the cylinder body. The lock core is pivotable about a longitudinal axis of the lock core hole between an initial position and a non-initial position. The keyway is adapted to receive a key. A setting unit is received in at least one of the cylinder body and the lock core. The setting unit can be controlled to move between an engagement position and a release position. The key is adapted to move the setting unit from the engagement position to the release position. An actuating block is fixed to the tail of the lock core and includes first and second lugs on an outer periphery thereof and spaced from each other in a circumferential direction about the longitudinal axis of the lock core hole. The first and second lugs are adapted to be operatively coupled with a door lock.

When the lock core is in the initial position and when the setting unit is in the engagement position, the lock core cannot pivot from the initial position to the non-initial position, and the lock core only permits insertion of the key into the keyway or removal of the key out of the keyway.

When the lock core is in the initial position and when the setting unit is in the release position, the lock core can pivot from the initial position to the non-initial position.

When the lock core is in the non-initial position, removal of the key out of the keyway is not permitted.

When the lock core moves from the non-initial position to the initial position, the second lug of the actuating block is adapted to change an operative state of one of an outer operating device and a latch device of the door lock to thereby prevent a latch of the latch device from being moved from a latching position to an unlatching position by operating the outer operating device of the door lock.

When the lock core moves from the initial position to the non-initial position, the first lug of the actuating block is adapted to change the operative state of one of the outer operating device and the latch device of the door lock to thereby permit the latch to be moved from the latching position to the unlatching position by operating the outer operating device.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
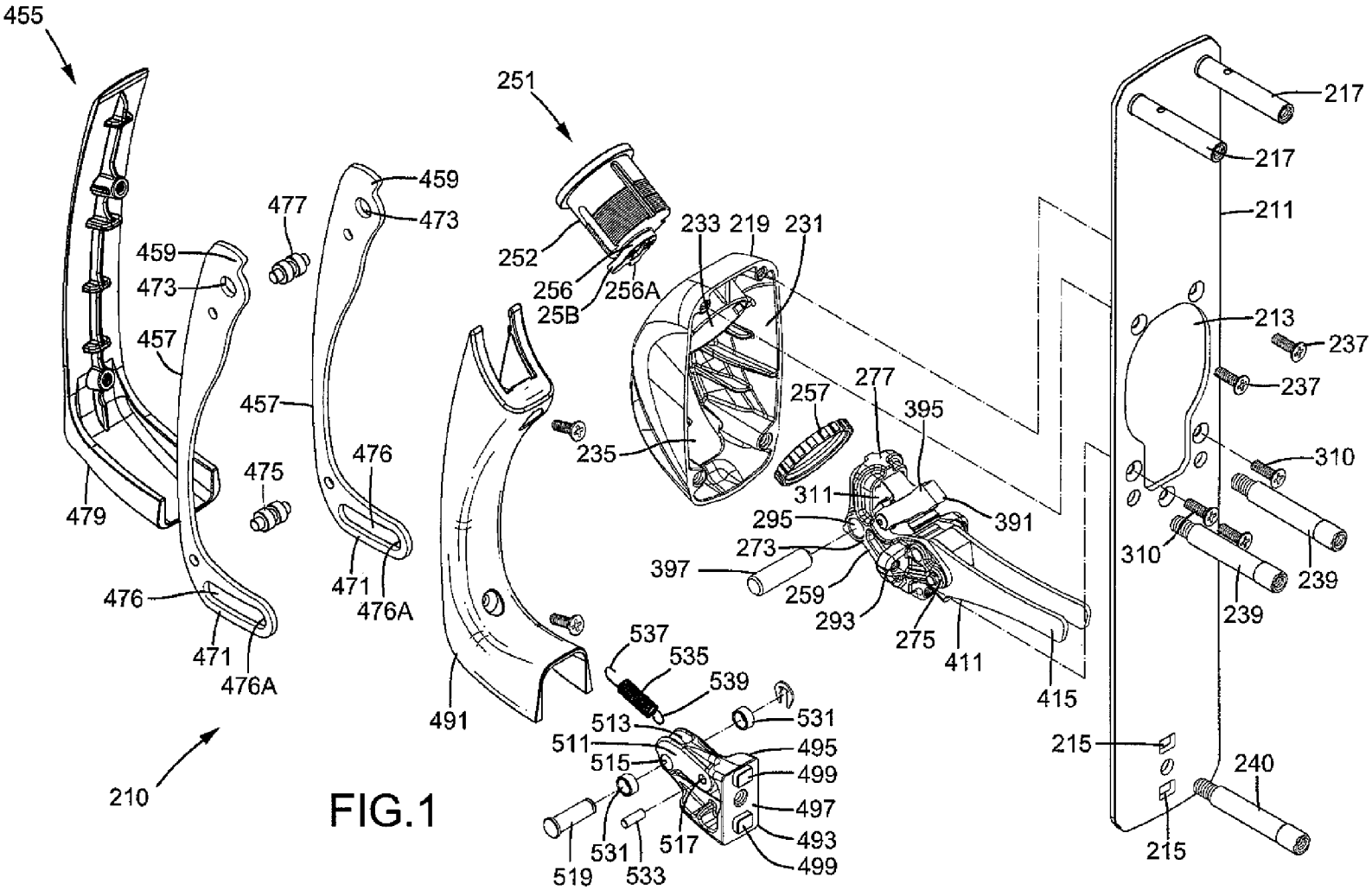
FIG. 1 is an exploded, perspective view of an outer operating device for a door lock.
Figure 1A:
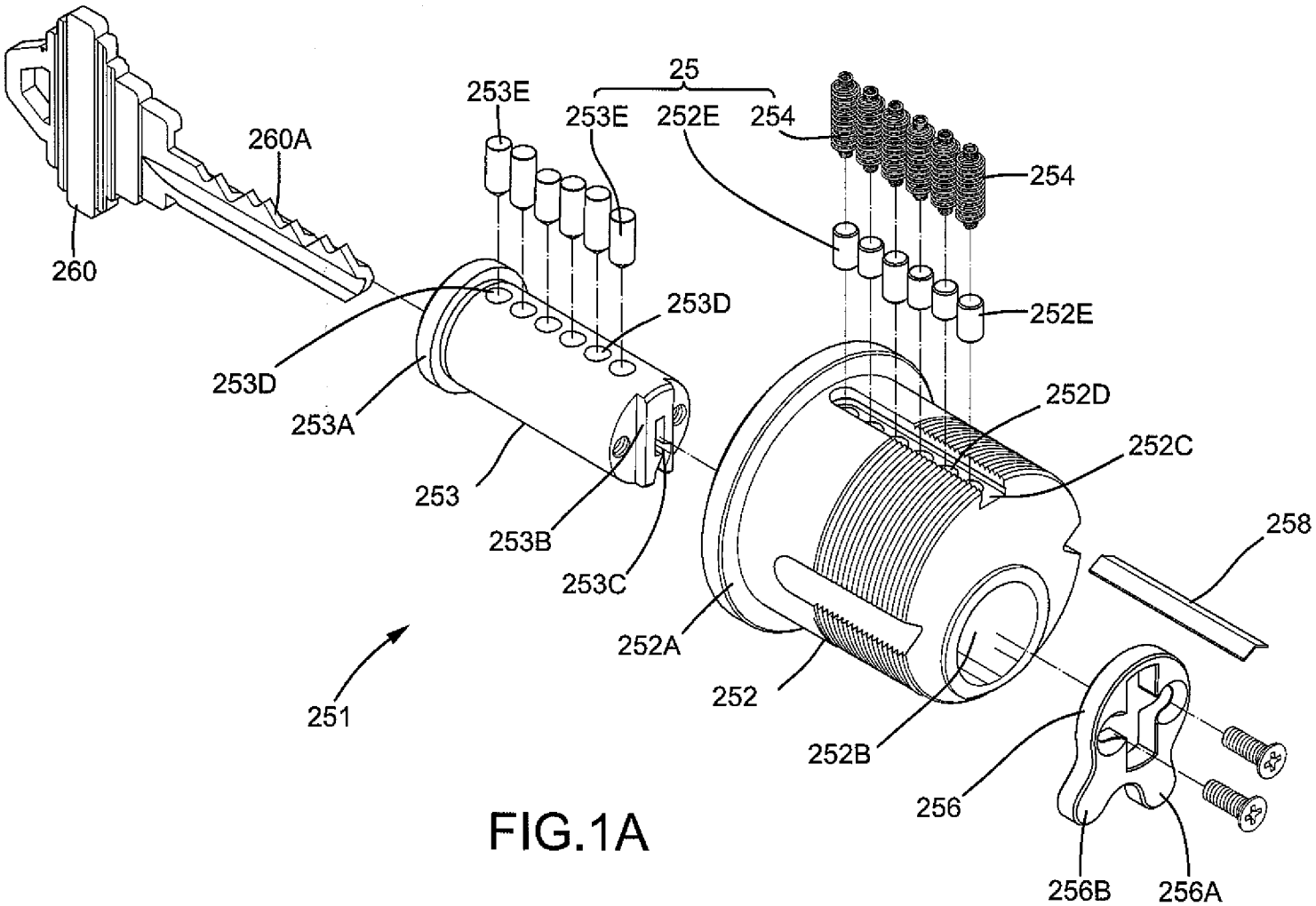
FIG. 1A is an exploded, perspective view of a lock core for a door lock according to the present invention.
Figure 2:
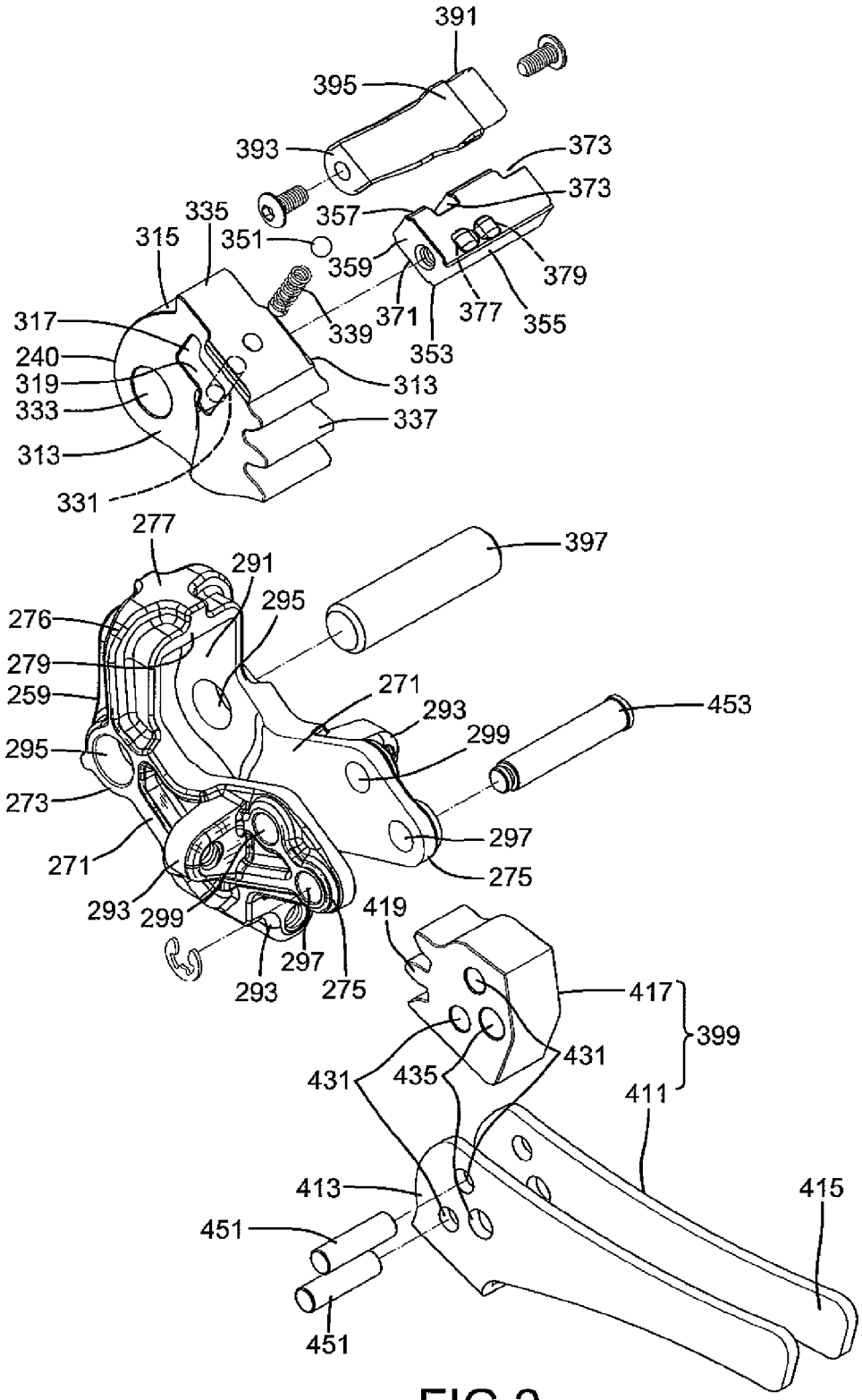
FIG. 2 is an exploded, perspective view of a portion of the outer operating device of FIG. 1.
Figure 3:
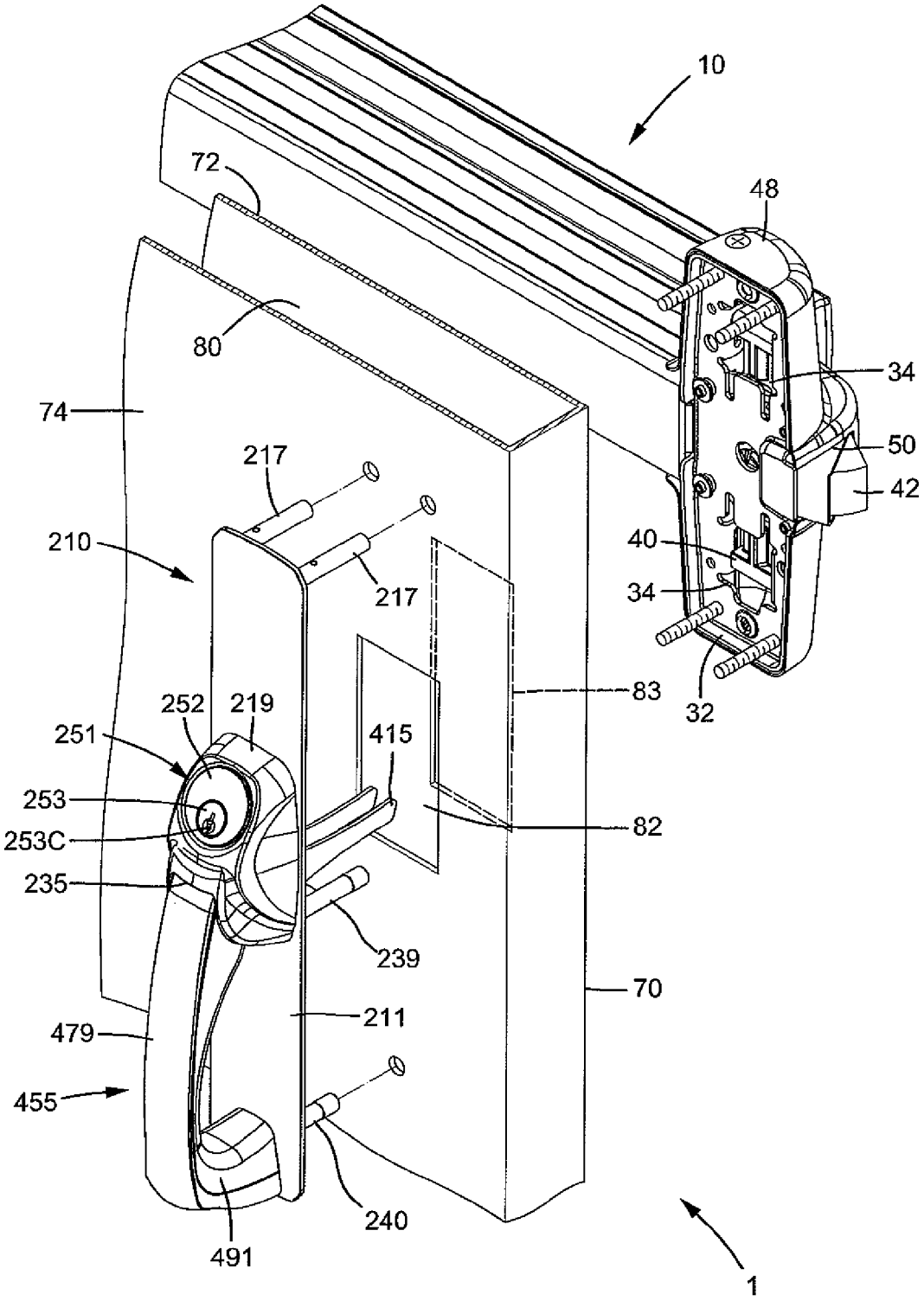
FIG. 3 is an exploded, perspective view of a door and a door lock including a latch device and utilizing the outer operating device of FIG. 1.

All figures are drawn for ease of explanation of the basic teachings only; the extensions of the figures with respect to number, position, relationship, and dimensions of the parts to form the illustrative embodiments will be explained or will be within the skill of the art after the following teachings have been read and understood. Further, the exact dimensions and dimensional proportions to conform to specific force, weight, strength, and similar requirements will likewise be within the skill of the art after the following teachings have been read and understood.

Where used in the various figures of the drawings, the same numerals designate the same or similar parts. Furthermore, when the terms “first”, “second”, “third”, “lower”, “upper”, “bottom”, “side”, “end”, “portion”, “spacing”, “length”, and similar terms are used herein, it should be understood that these terms have reference only to the structure shown in the drawings as it would appear to a person viewing the drawings and are utilized only to facilitate describing the illustrative embodiments.

DETAILED DESCRIPTION OF THE INVENTION

FIG. 1 shows an outer operating device 210 including a mounting plate 211 having a through-hole 213 and two coupling holes 215. Two mounting posts 217 are fixed to a side of mounting plate 211. Each mounting post 217 includes an end having a screw hole. Through-hole 213 is located between mounting posts 217 and coupling holes 215. Outer operating device 210 further includes a casing 219 fixed to mounting plate 211. Casing 219 includes a first installation chamber 231 and a second installation chamber 233 defined in an inner wall of first installation chamber 231. Casing 219 further includes a through-slot 235 extending from an outer face of casing 219 to first installation chamber 231. Two first screws 237 and two first engagement rods 239 extend through mounting plate 211 into casing 219 to fix casing 219 to mounting plate 211, with first installation chamber 231 aligned with through-hole 213. Each engagement rod 239 has a screw hole in an end thereof.

Outer operating device 210 further includes a mounting seat 259 having two substantially L-shaped sidewalls 271 and a connecting wall 277 extending between sidewalls 271. Connecting wall 277 includes a stop face 279. Each sidewall 271 includes a first pivotal end 273, a second pivotal end 275, and a stop end 276 adjacent to connecting wall 277. First pivotal end 273 is located between stop end 276 and second pivotal end 275. An installation space 291 is defined by sidewalls 271 and connecting wall 277. Mounting seat 259 further includes two aligned first fixing holes 295, two aligned second fixing holes 297, and two aligned third fixing holes 299. Each first fixing hole 295, each second fixing hole 297, and each third fixing hole 299 extend from an outer face through an inner face of one of sidewalls 271. Each first fixing hole 295 is located in first pivotal end 273. Each of second fixing holes 297 and third fixing holes 299 is located in second pivotal end 275. Each third fixing hole 299 is located between one of first fixing holes 295 and one of second fixing holes 297. Mounting seat 259 further includes three lugs 293.

Three second screws 310 extend through mounting plate 211 into lugs 293 of mounting seat 259. Thus, mounting seat 259 is fixed to mounting plate 211 and is located in first installation chamber 231 of casing 219. Furthermore, second pivotal end 275 passes through through-hole 213 of mounting plate 211 to an inner side of mounting plate 211.

Outer operating device 210 further includes a driving wheel 311 pivotably mounted in installation space 291 of mounting seat 259. Driving wheel 311 includes first and second sides 313 and an outer periphery 315 extending between first and second sides 313. Formed on outer periphery 315 of driving wheel 311 are a stop block 335 and a driving toothed portion 337 spaced from stop block 335 in a circumferential direction about a pivotal axis of driving wheel 311. Driving toothed portion 337 includes a plurality of teeth. Driving wheel 311 further includes an axle hole 333 and a track 317. Each of axle hole 333 and track 317 extends from first side 313 through second side 313. Track 317 is located between stop block 335 and driving toothed portion 337. Track 317 includes a bottom face 319 having a groove 331.

Axle hole 333 of driving wheel 311 is aligned with first fixing holes 295 of mounting seat 259. An axle 397 includes two ends respectively fixed in first fixing holes 295. Axle 397 is pivotably received in axle hole 333. Driving wheel 311 is pivotable about a pivotal axis defined by axle 397. Furthermore, stop block 335 of driving wheel 311 faces stop end 276 of mounting seat 259, and driving toothed portion 337 faces second pivotal end 275.

Outer operating device 210 further includes a movable block 353 slideably engaged with track 317 and a follower 391 coupled to movable block 353. Movable block 353 includes a first face 355 and a second face 357 opposite to first face 355. Movable block 353 further includes two end faces opposite to each other and extending between first and second faces 355 and 357. Movable block 353 further includes a lower face 371 extending between first and second faces 355 and 357 and between end faces 359. Movable block 353 further includes two notches 373 defined in second face 357 and spaced from each other. Movable block 353 further includes first and second positioning grooves 377 and 379 defined in lower face 371 and spaced from each other.

Figure 12:
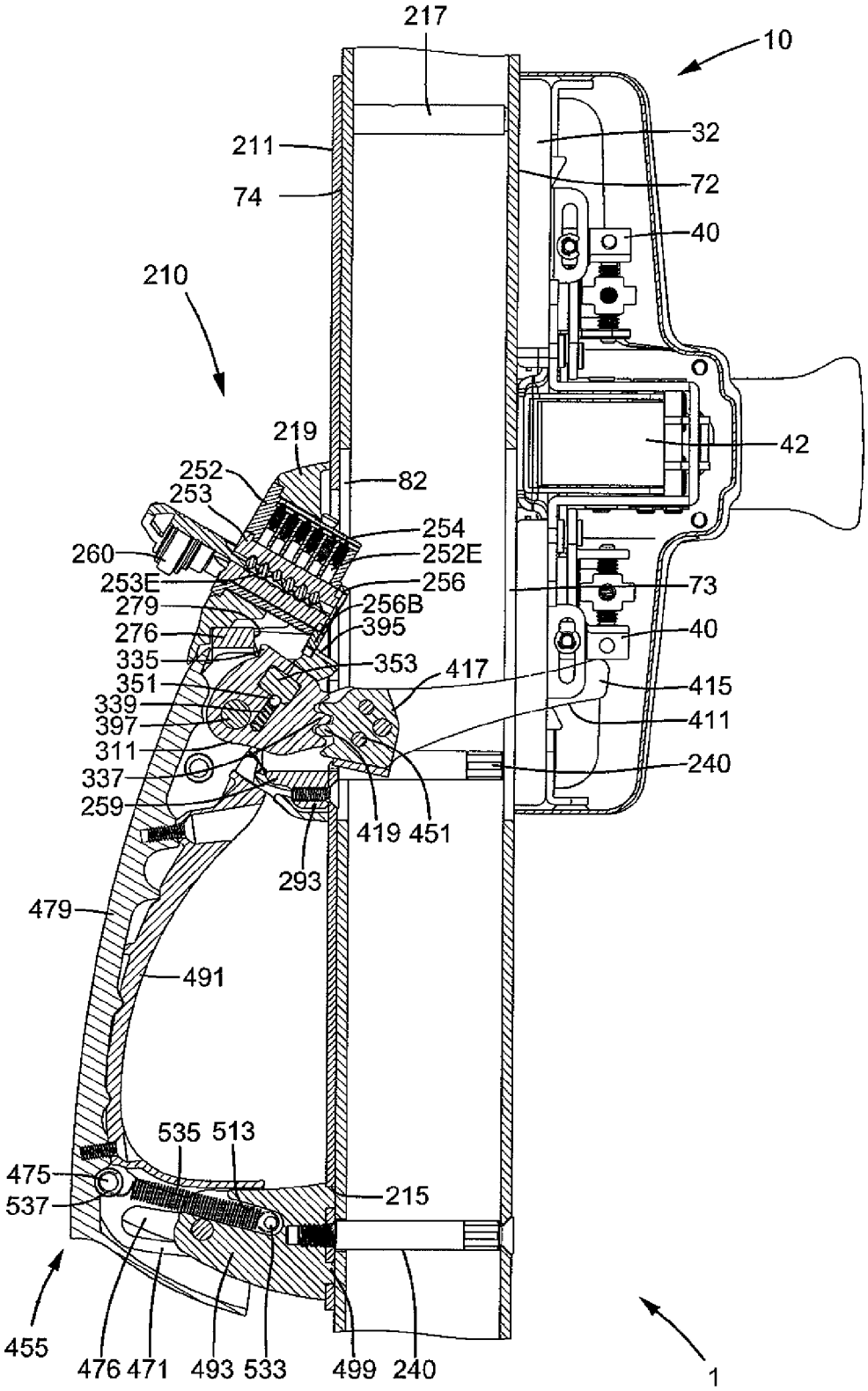
FIG. 12 is a cross sectional view taken along section line 12-12 of FIG. 9.
Figure 13:
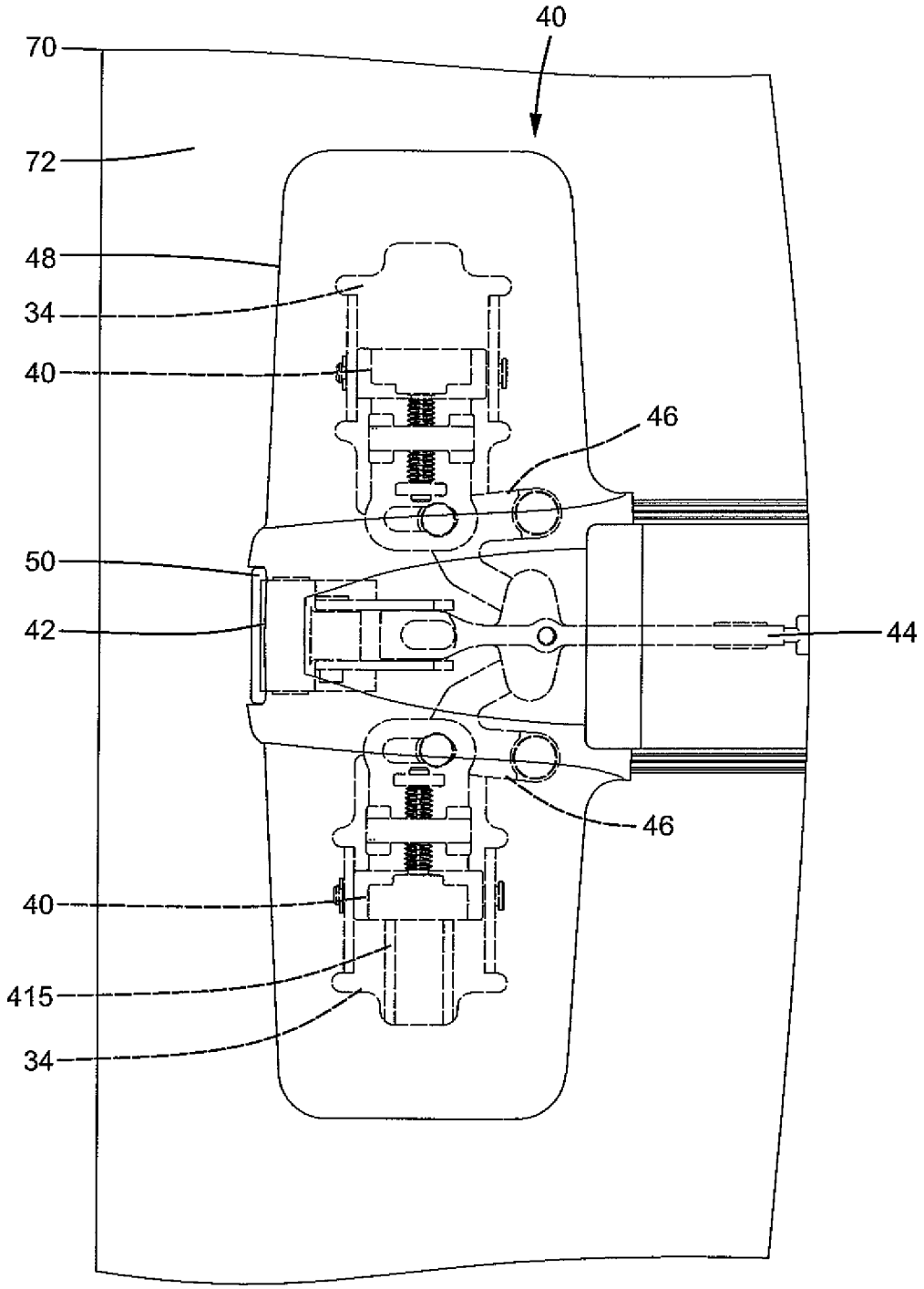
FIG. 13 is a view similar to FIG. 4 with the latch moved from the latching position to an unlatching position by operating the outer operating device.

Lower face 371 of movable block 353 faces bottom face 319 of track 317 of driving wheel 311. Second face 357 and each notch 373 face stop block 335. Movable block 353 is retrained by track 317 and is pivotable about the pivotal axis defined by axle 397 between a joint movement position (FIGS. 5-7) and a disengagement position (FIGS. 12-14). When movable block 353 is in the joint movement position, first positioning groove 377 of movable block 353 is aligned with groove 331 of track 317 of driving wheel 311.

Follower 391 includes two engagement portions 393 corresponding to end faces 359 of movable block 353. Follower 391 further includes a protrusion 395 between engagement portions 393. Follower 391 extends across movable block 353, and each engagement portion 393 abuts a corresponding end face 359. Two screws extend through engagement portions 393 into screw holes in end faces 359 of movable block 353. Thus, follower 391 and movable block 353 move jointly between the joint movement position and the disengagement position. Furthermore, a compression spring 339 and a positioning member 351 are received in groove 331 of track 317 of driving wheel 311. Compression spring 339 biases positioning member 351 towards movable block 353, such that positioning member 351 selectively engages with one of first and second positioning grooves 377 and 379 to position movable block 353.

Outer operating device 210 further includes a driving member 399 pivotably mounted in installation space 291 of mounting seat 259. Driving member 399 includes a follower portion 417 and a driving portion 411. Driving portion 411 includes an engagement end 413 and a distal end 415 distant to follower portion 417. Follower portion 417 includes a driven toothed portion 419 having a plurality of teeth. Follower portion 417 is received in engagement end 413 of driving portion 411. Each of driving portion 411 and follower portion 417 includes a through-hole 435 and two fixing holes 431. Two fixing pins 451 extend through fixing holes 431 of driving portion 411 and follower portion 417. Thus, follower portion 417 can not move relative to driving portion 411.

Figure 5:
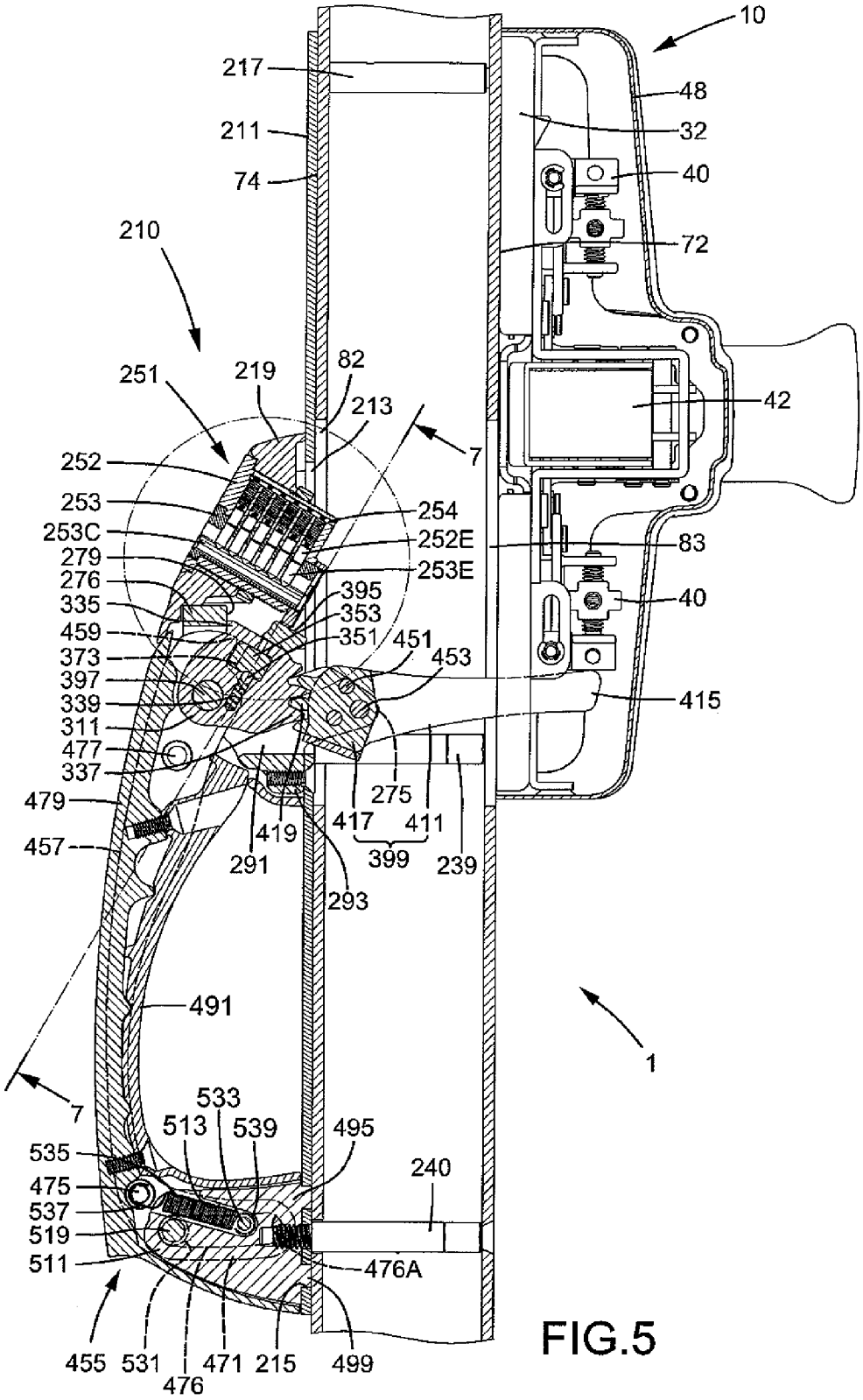
FIG. 5 is a cross sectional view taken along section line 5-5 of FIG. 4.
Figure 6:
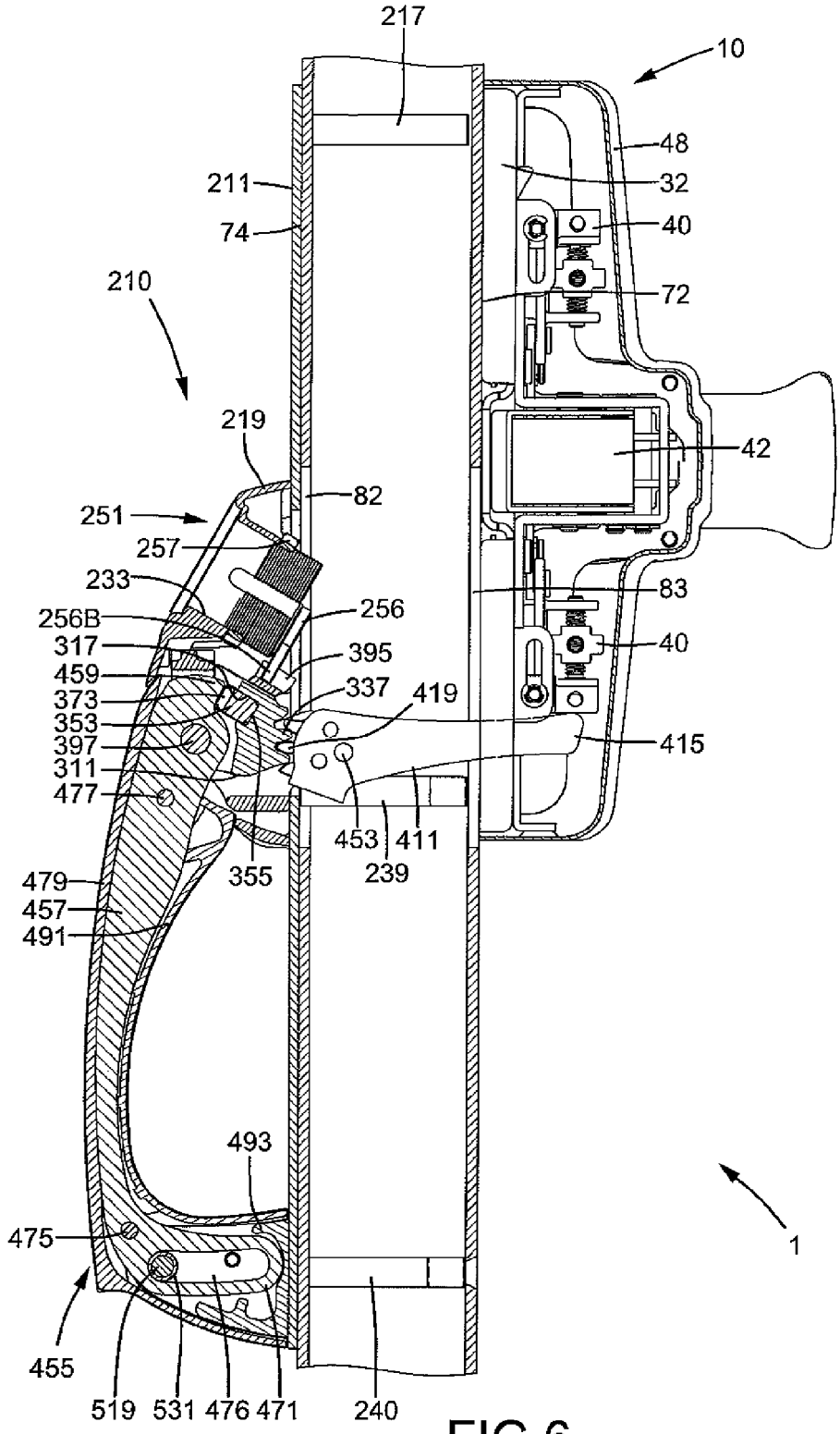
FIG. 6 is a cross sectional view taken along section line 6-6 of FIG. 4.
Figure 9:
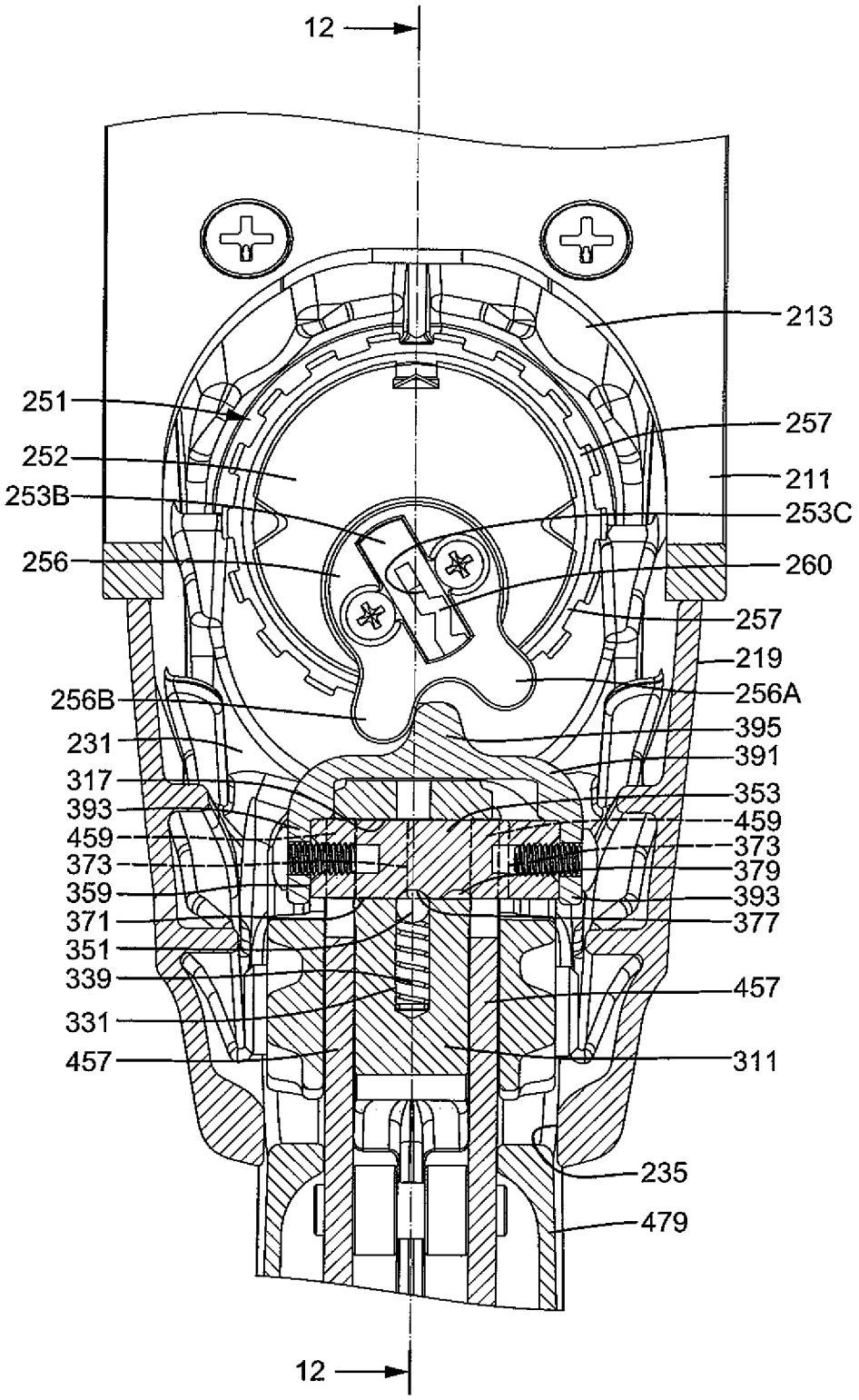
FIG. 9 is a view similar to FIG. 7 with a lock core of the clock cylinder rotated by a key from an initial position to a non-initial position.

Through-holes 435 of driving member 399 are aligned with second fixing holes 297 of mounting seat 259. A pivotal pin 453 includes two ends mounted in second fixing holes 297 of mounting seat 259 and is pivotably received in through-holes 435 of driving member 399. Furthermore, driven toothed portion 419 of driving member 399 meshes with driving toothed portion 337 of driving wheel 311. Thus, when driving wheel 311 pivots, driving member 399 pivots about a pivotal axis defined by pivotal pin 453 between a pressing position in which distal end 415 is in an upper position (FIGS. 9-10) and a release position in which distal end 415 is in a lower position (FIGS. 5-6).

Outer operating device 210 further includes a handle 455 pivotably connected to mounting seat 259. Handle 455 includes two levers 457 having the same shape in the forms shown in FIGS. 1-21. Each lever 457 includes a pressing end 459 and a movable end 471. Each lever 457 further includes an axle hole 473 adjacent to pressing end 459 and a limiting slot 476 in movable end 471. Limiting slot 476 of each lever 457 includes an end 476A adjacent to a distal portion of movable end 471. First and second connecting members 475 and 477 are mounted between two levers 457. First and second connecting members 475 and 477 have the same shape and size in the forms shown in FIGS. 1-21. Thus, levers 457 are kept spaced from and parallel to each other. First connecting member 475 is located adjacent to the other end of a corresponding limiting slot 476. Second connecting member 477 is located adjacent to each axial hole 473. Furthermore, first connecting member 475 is located between second connecting member 477 and each limiting slot 476.

Pressing end 459 of each lever 457 is received between one of first and second sides 313 of driving wheel 311 and a corresponding sidewall 271 of mounting seat 259. Axle 397 is pivotably received in axle holes 473 of levers 457. The remaining portion of each lever 457 extends through through-slot 235 of casing 219 to the outside of casing 219. Thus, levers 457 can pivot about a pivotal axis defined by axle 397. Pressing end 459 of each lever 457 faces second face 357 of movable block 353. Handle 455 further includes first and second handle casing 479 and 491 that couple with each other to form a handle casing receiving levers 457.

Outer operating device 210 includes a coupling seat 493 fixed to mounting plate 211 and located below casing 219. Coupling seat 493 includes a body 495 having an end face 497 with two insertion blocks 499. Coupling seat 493 further includes an extension 511 extending from body 495. Extension 511 includes a chamber 513. Extension 511 further includes first and second holes 515 and 517, with each of first and second holes 515 and 517 extending along an axis parallel to the pivotal axis defined by axle 397. First and second holes 515 and 517 are spaced from each other. Second hole 517 intersects with chamber 513.

End face 497 of coupling seat 493 abuts mounting plate 211. Each insertion block 499 of coupling seat 493 engages with one of coupling holes 215 of mounting plate 211. A second engagement rod 240 includes an end extending through mounting plate 211 into body 495 of coupling seat 493, fixing coupling seat 493 to mounting plate 211. A screw hole is defined in the other end of second engagement rod 240.

A first fixing pin 519 is mounted in first hole 515 of coupling seat 493. A cap 531 is mounted to each of two ends of first fixing pin 519 located outside of extension 511 of coupling seat 493. Each cap 531 is received in limiting slot 476 of one of levers 457. Thus, when handle 455 is pulled, each lever 457 pivots until end 476A of each limiting slot 476 abuts an outer periphery of a corresponding cap 531, preventing damage to the internal structure of outer operating device 210 resulting from excessive pivotal movement of handle 455. A second fixing pin 533 is received in second hole 517. A tension spring 535 is received in chamber 513 of coupling seat 493. Tension spring 535 includes a first end 537 attached to first connecting member 475 and a second end 539 located in chamber 513 and attached to second fixing pin 533. Thus, when handle 455 pivots, first end 537 of tension spring 535 is pulled, providing a returning force for returning handle 455.

Outer operating device 210 further includes a lock cylinder 251 mounted in second installation chamber 233 of casing 219. Lock cylinder 251 includes a cylinder body 252 having a flange 252A on an end thereof. Cylinder body 252 further includes a lock core hole 252B extending from the end through the other end of cylinder body 252. Cylinder body 252 further includes a channel 252C in an outer periphery thereof. A plurality of upper tumbler pin holes 252D extends from a bottom face of channel 252C to lock core hole 252B and is spaced from each other along a length of channel 252C. A locking ring 257 is threadedly engaged with a threaded portion on an outer periphery of cylinder body 252. Locking ring 257 abuts casing 219. Flange 252A is received in an outer side of casing 219. Thus, lock cylinder 251 is fixed in second installation chamber 233.

Figure 10:
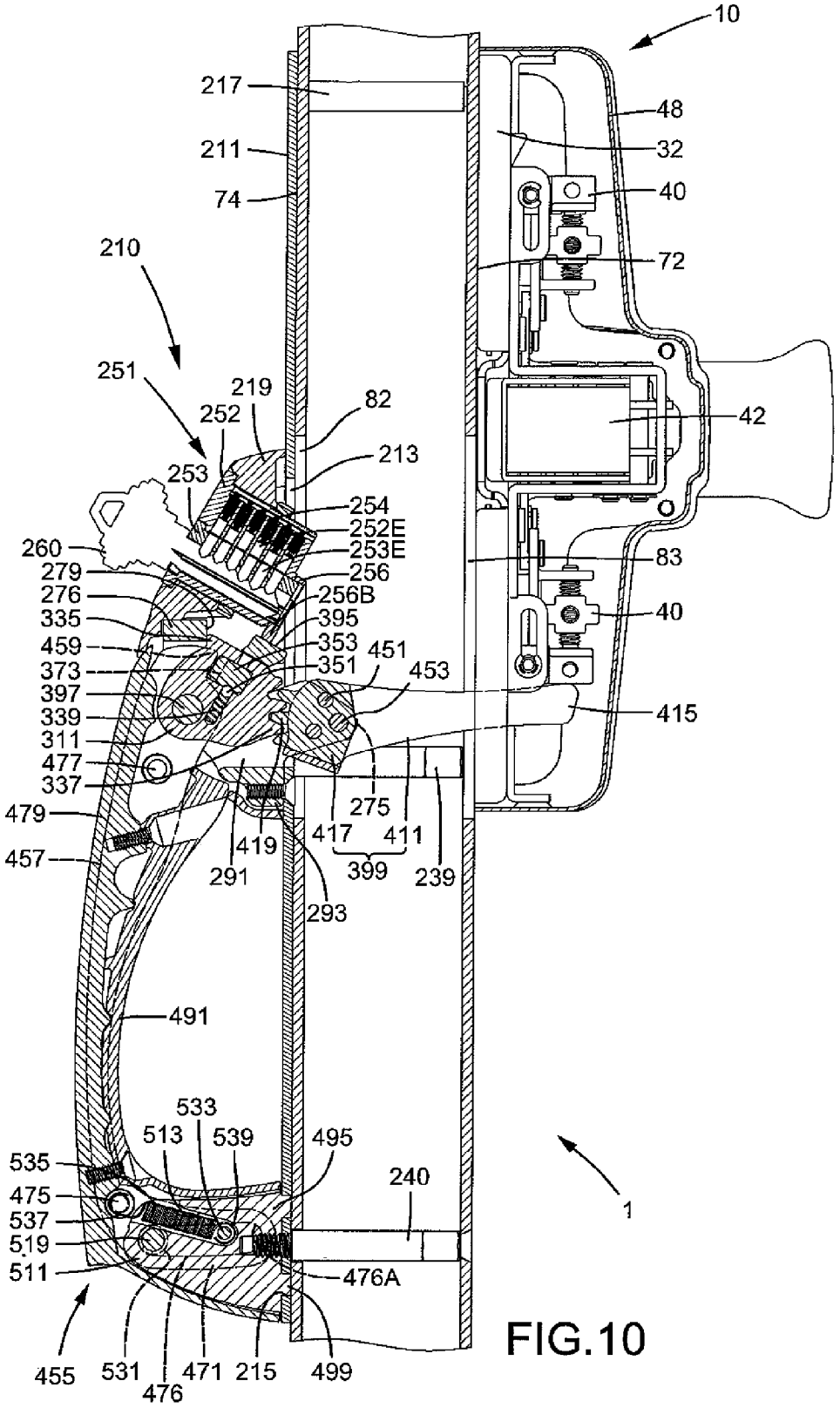
FIG. 10 is a cross sectional view taken along section line 10-10 of FIG. 7.

In the form shown, lock cylinder 251 further includes a lock core 253 pivotably received in lock core hole 252B of cylinder body 252. Lock core 253 includes a head 253A and a tail 253B. Lock core 253 further includes a keyway 253C extending from head 253A through tail 253B. Lock core 253 further includes a plurality of lower tumbler pin holes 253D spaced from each other along a longitudinal axis of lock core 253. Head 253A is adjacent to flange 252A. Tail 253B is located outside of cylinder body 252. Lock core 253 is pivotable about a longitudinal axis of lock core hole 252 between an initial position (FIGS. 5A and 7) and a non-initial position (FIGS. 10 and 12). When lock core 253 is in the initial position, a central axis of each lower tumbler pin hole 253D of lock core 253 is coincident to a central axis of a corresponding upper tumbler pin hole 252D of cylinder body 252. Namely, each lower tumbler pin hole 253D is aligned with the corresponding upper tumbler pin hole 252D. On the other hand, when the lock core 253 is in the non-initial position, the central axis of each lower tumbler pin hole 253D of lock core 253 is spaced from the central axis of the corresponding upper tumbler pin hole 252D of cylinder body 252 in a circumferential direction about the longitudinal axis defined by lock core hole 252B. Namely, each lower tumbler pin hole 253D is not aligned with the corresponding upper tumbler pin hole 252D.

Figure 5A:
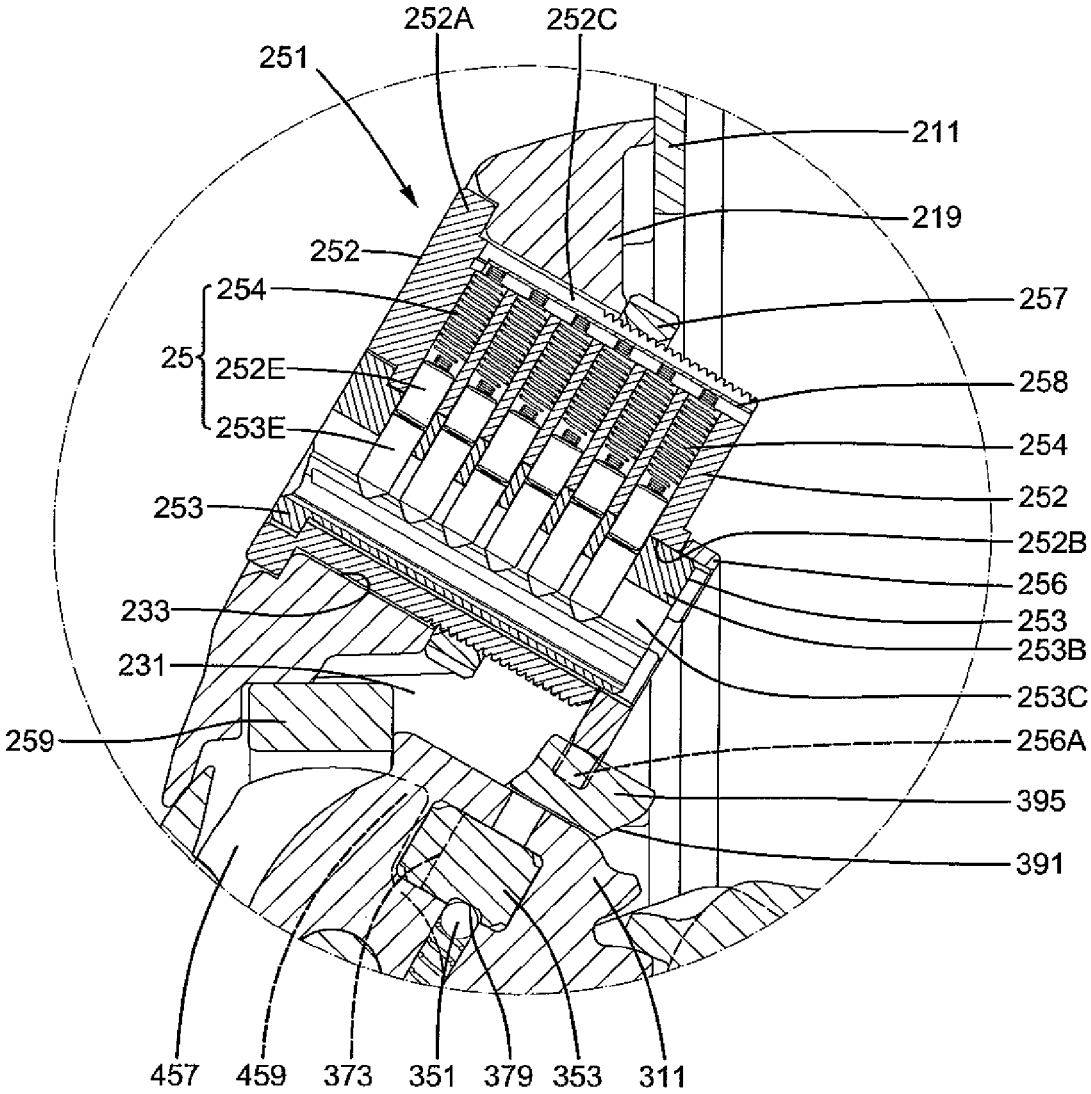
FIG. 5A is an enlarged view of a circled portion of FIG. 5.

In the form shown, lock cylinder 251 further includes a plurality of setting units 25 between cylinder body 252 and lock core 253. Each setting unit 25 includes an upper tumbler pin 252E received in one of upper tumbler pin holes 252D, a lower tumbler pin 253E received in one of lower tumbler pin holes 253D, and a spring 254 received in one of upper tumbler pin holes 252D and located between upper tumbler pin 252E and a lid 258. Each spring 254 biases the corresponding upper tumbler pin 252E against the corresponding lower tumbler pin 253E. Upper tumbler pins 252E have different lengths. Likewise, lower tumbler pins 253E have different lengths. Thus, when lock core 253 is in the initial position and when a key 260 is not inserted into keyway 253C, a bottom of each lower tumbler pin 253E enters keyway 253C, the contact faces respectively of upper and lower tumbler pins 252E and 253E in lower tumbler pin holes 253D are not aligned with a gap between lock core 253 and lock core hole 252B and, thus, cannot form a shear line, as shown in FIG. 5A. In this case, each upper tumbler pin 252E is located in a corresponding pair of upper and lower tumbler pin holes 252D and 253D aligned with each other, such that lock core 253 cannot pivot from the initial position to the non-initial position. However, when lock core 253 is in the initial position, each setting unit 25 can move between an engagement position (FIG. 5A) and a disengagement position (FIG. 10) in a corresponding pair of upper and lower tumbler pin holes 252D and 253D aligned with each other. Key 260 includes a plurality of serrations 260A corresponding to the lengths of the upper and lower tumblers 252E and 253E.

When lock core 253 is in the initial position and when each setting unit 25 is in the engagement position (FIG. 5A), the contact faces of upper and lower tumbler pins 252E and 253E are not aligned with the gap between lock core 253 and lock core hole 252B and, thus, cannot form the shear line. In this case, lock core 253 cannot pivot from the initial position to the non-initial position.

On the other hand, when lock core 253 is in the initial position and when each setting unit 25 is in the release position (FIG. 10), the contact faces of upper and lower tumbler pins 252E and 253E are aligned with the gap between lock core 253 and lock core hole 252B and, thus, form the shear line. In this case, lock core 253 can pivot from the initial position to the non-initial position (FIG. 12).

Figure 7:
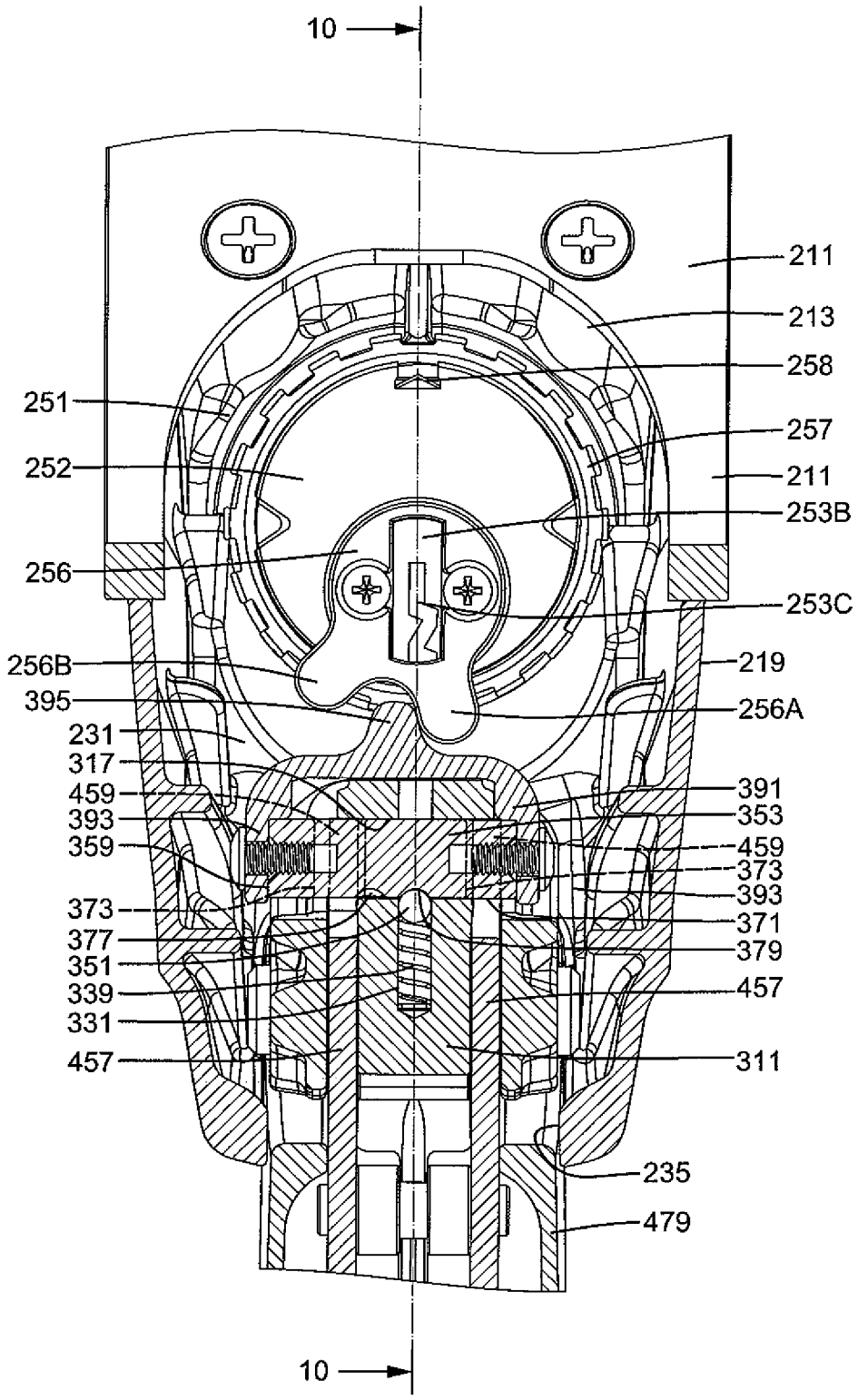
FIG. 7 is a cross sectional view taken along section line 7-7 of FIG. 5.
Figure 8:
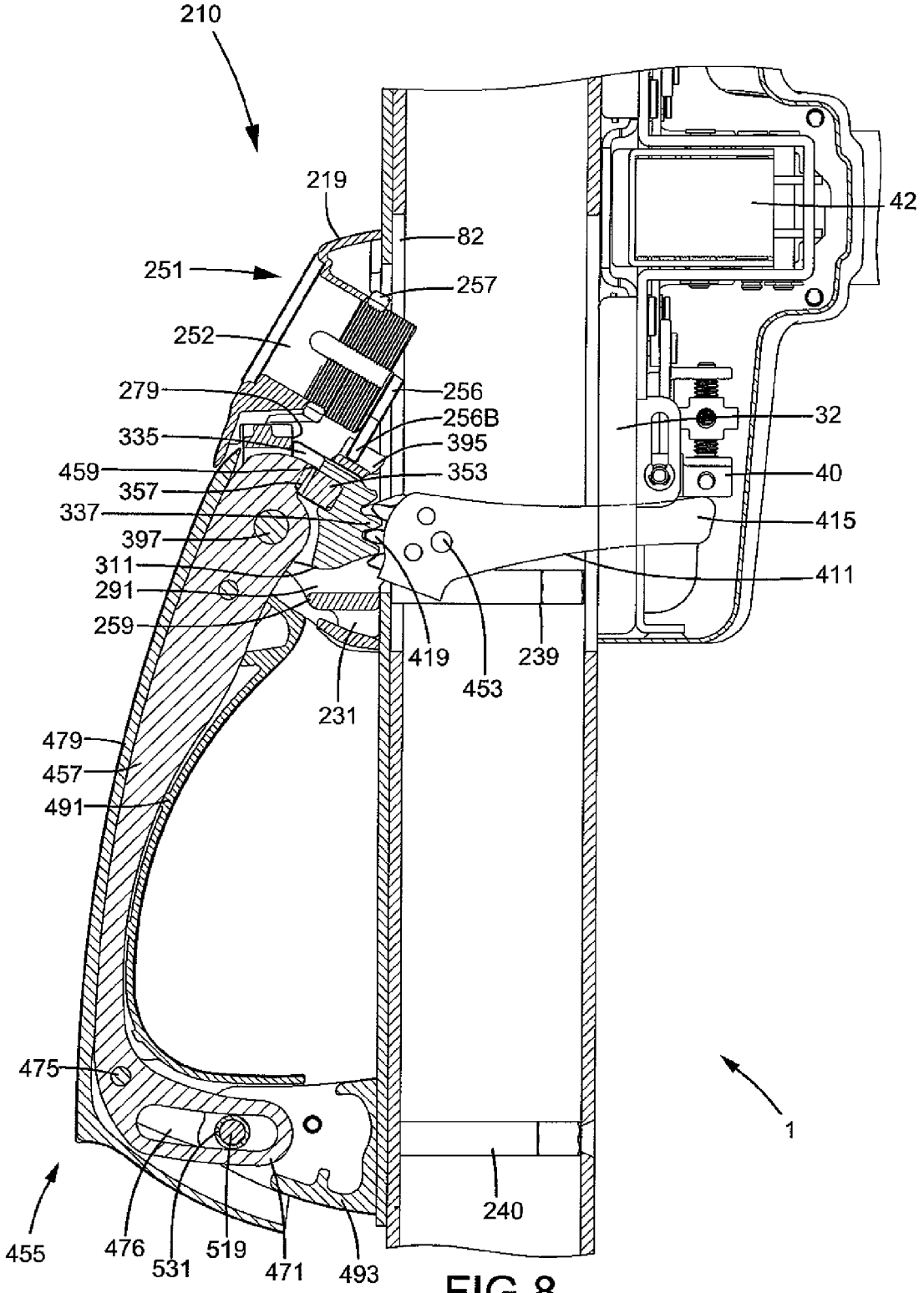
FIG. 8 is a view similar to FIG. 5 with a handle of the outer operating device pivoted and with a latch of the latch device in a latching position.

In the form shown, lock cylinder 251 further includes an actuating block 256 fixed to tail 253B of lock core 253, allowing joint pivotal movement of actuating block 256 and lock core 253. Actuating block 256 includes first and second lugs 256A and 256B on an outer periphery thereof and spaced from each other in the circumferential direction about the longitudinal axis of lock core hole 252B. Protrusion 395 of follower 391 is located between first and second lugs 256A and 256B (FIG. 7).

Outer operating device 210 is mounted to an outer side 74 of door 70. Latch device 10 is mounted to an inner side 72 of door 70. A door lock 1 is formed by latch device 10 and outer operating device 210. Door 70 includes space 80 between inner and outer sides 72 and 74. Door 70 further includes a first opening 82 defined in outer side 74 and intercommunicated with space 80. Door 70 further includes a second opening 83 defined in inner side 72 and intercommunicated with space 80. Mounting plate 211 abuts outer side 74 of door 70. Distal end 415 of driving member 399 passes through first and second openings 82 and 83 to a position beyond inner side 72. Mounting posts 217, first engagement rods 239, and second engagement rods 240 are received in space 80 of door 70.

Latch device 10 can be of any desired form as conventional including, but not limited to, of a commercially available type. In the form shown, latch device 10 includes a base 32 fixed to inner side 72 of door 70 and having two slots 34. A slide 40 is slideably received in each slot 34. Latch device 10 further includes a pull rod 44 and two link 46. Pull rod 44 is movable relative to base 32 along an axis parallel to the pivotal axis defined by axle 397. Each link 46 is pivotably mounted between pull rod 44 and one of slides 40. Each link 46 has an end pivotably connected to base 32. Latch device 10 further includes a latch 42 pivotably connected to pull rod 44 and base 32. When pull rod 44 moves along the axis, each link 46 pivots relative to base 32, such that each slide 40 moves towards or away from pull rod 44, moving latch 42 between a latching position (FIG. 4) and an unlatching position (FIG. 13).

Base 32 of latch device 10 abuts inner side 72 of door 70. Each mounting post 217 of outer operating device 210 is aligned with one of first engagement rods 239. Screws extend through base 32 of latch device 10 into the screw holes in mounting posts 217 and the screw holes in first engagement rods 239. Thus, outer operating device 210 is fixed to outer side 74 of door 70, and latch device 10 is fixed to inner side 72 of door 70. A casing 48 covers latch device 10 and includes a notch 50 through which latch 42 extends. Furthermore, distal end 415 of driving member 399 of outer operating device 210 extends through a lower one of slots 34 of base 32 and abuts a bottom of one of slides 40 (FIGS. 5 and 6).

Now that the basic construction of outer operating device 210 has been explained, the operation and some of the advantages of outer operating device 210 can be set forth and appreciated. In particular, for the sake of explanation, it will be assumed that latch 42 of latch device 10 is in the latching position (FIG. 4), such that driving member 399 of outer operating device 210 is in the release position, and such that stop block 335 of driving wheel 31 abuts stop face 279 of mounting seat 259. It is further assumed that lock core 253 of lock cylinder 251 is in the initial position, that movable block 353 of outer operating device 210 is in the disengagement position (FIGS. 5-7), and that compression spring 339 biases positioning member 351 to engage with second positioning groove 379 of movable block 353 (FIGS. 5A and 7). Thus, movable block 353 is positioned in the disengagement position. Furthermore, pressing end 459 of each lever 457 is aligned with a corresponding notch 373 of movable block 353.

In a case that handle 455 is pulled away from outer side 74 of door 70 while lock core 253 is in the initial position, pivotal movement of each lever 457 of handle 455 causes each movable end 471 to move away from mounting plate 211. Thus, first connecting member 475 pulls tension spring 535 to provide the returning force for handle 455. Furthermore, pressing end 459 of each lever 457 moves into a corresponding notch 373 of movable block 353. Thus, each lever 457 cannot actuate movable block 353 to pivot driving wheel 31. As a result, driving member 399 remains in the release position, such that driving member 399 cannot move slides 40 of latch device 10. Accordingly, latch 42 of latch device 10 remains in the latching position. Namely, outer operating device 210 provides a locking function. As a result, if door 70 is in the closed state, door 70 cannot be opened by operating handle 455 of outer operating device 210.

Figure 11:
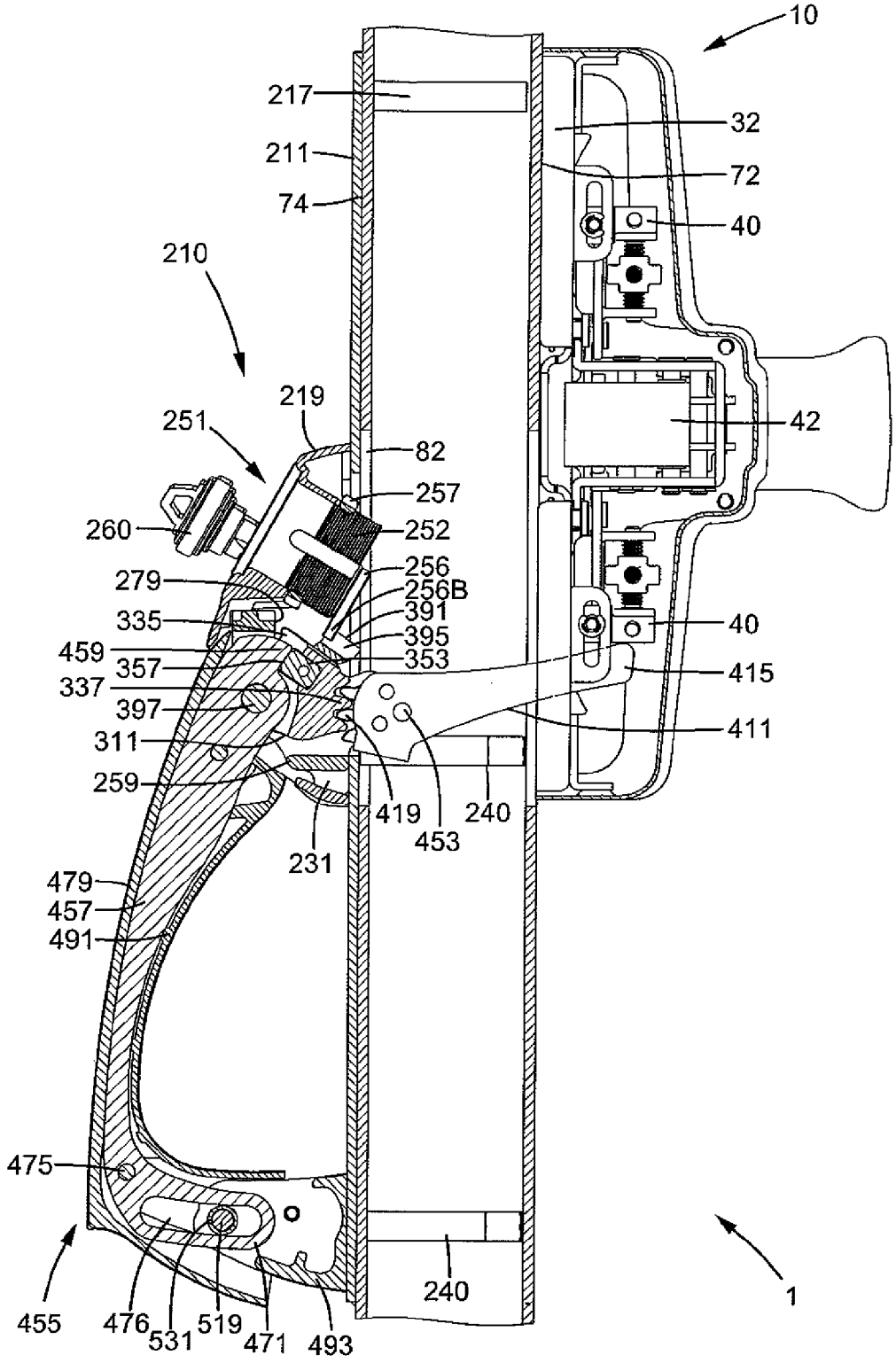
FIG. 11 is a view similar to FIG. 5 with the key inserted into the lock core and turned.

If it is desired to unlock outer operating device 210 while door 70 is closed, key 260 is inserted into keyway 253C of lock core 253. Serrations 260A of key 260 press against lower tumbler pins 253E to move each setting unit 25 from the engagement position (FIGS. 5 and 5A) to the release position (FIG. 10), permitting key 260 to pivot lock core 253 from the initial position to the non-initial position. At the same time, lower tumbler pin 253E of each setting unit 25 pivots together with lock core 253, such that each lower tumbler pin 253E is limited by an inner periphery of lock core hole 252B of cylinder body 252 and serrations 260A of key 260 and, thus, cannot move along a longitudinal axis of lower tumbler pin hole 253D. Thus, key 260 cannot be removed out of keyway 253C of lock core 253. Movement of lock core 253 from the initial position to the non-initial position causes second lug 256B of actuating block 256 of lock cylinder 251 to press against protrusion 395 of follower 391 (FIG. 9), moving follower 391 and movable block 353 from the disengagement position (FIGS. 12-14) to the joint movement position (FIGS. 5-7). Compression spring 339 biases positioning member 351 to engage with first positioning groove 377 and, thus, position movable block 353 in the joint movement position. In this case, each notch 373 of movable block 353 is not aligned with pressing end 459 of a corresponding lever 457 (FIG. 11). If handle 455 is pulled in this state, pressing end 459 of each lever 457 presses against second face 357 of movable block 353. Movable block 353 causes driving wheel 311 and follower 391 to jointly pivot away from stop face 279 of mounting seat 259 about the pivotal axis defined by axle 397. Driving toothed portion 337 of driving wheel 311 drives driven toothed portion 419 of driving member 399, pivoting driving member 399 in a reverse direction to move driving member 399 from the release position (FIGS. 5 and 6, distal end 415 is in the lower position) to the pressing position (FIGS. 11 and 12, distal end 415 is in the upper position). The slide 40 of latch device 10 abutting driving member 399 is pressed against distal end 415 of driving member 399, moving the slide 40 towards pull rod 44 (FIG. 13). A corresponding link 46 pivotably connected to the slide 40 pivots and pulls pull rod 44 to move along the axis parallel to the pivotal axis defined by axle 397, further moving the other slide 40 and the other link 46. Thus, latch 42 is moved by pull rod 44 from the latching position (FIG. 4) to the unlatching position (FIG. 13). Since the moving direction of handle 455 is the same as the direction for opening door 70, door 70 is opened when latch 42 has reached the unlatching position.

Figure 4:
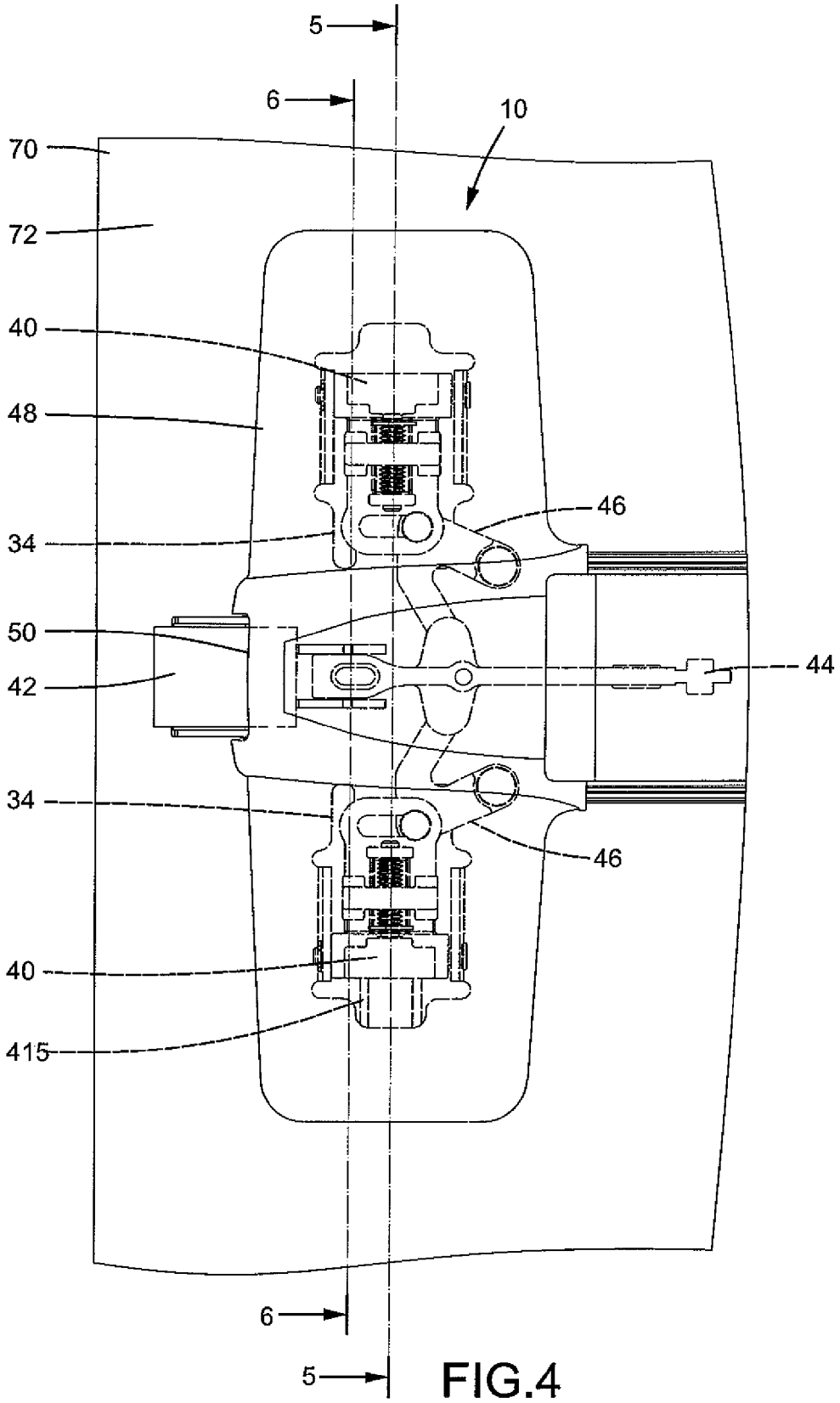
FIG. 4 is a side elevational view of the latch device mounted to an inner side of the door of FIG. 3.

When latch 42 is in the unlatching position and door 70 is open, if handle 455 is released, tension spring 535 returns movable end 471 of each lever 457 of handle 455 (movable end 471 moves towards mounting plate 211), causing pressing end 459 of each lever 457 to move away from second face 357 of movable block 353. Each slide 40 of latch device 10 is returned by a returning device of latch device 10 (each slide 40 moves away from pull rod 44). Each link 46 returns pull rod 44 by moving pull rod 44 along the axis parallel to the pivotal axis defined by axle 397 towards latch 42, moving latch 42 from the unlatching position (FIG. 13) to the latching position (FIG. 4). At the same time, the slide 40 abutting driving member 399 presses against distal end 415 of driving member 399 to pivot driving member 399 from the pressing position (FIGS. 11 and 12) to the release position (FIGS. 5 and 6). Driven toothed portion 419 of driving member 399 drives driving toothed portion 337 of driving wheel 311 to pivot driving wheel 311 in a reverse direction until stop block 335 abuts stop face 279 of mounting seat 259.

After door 70 is opened, since lock core 253 is still in the non-initial position, each lower tumbler pin 253E prevents key 260 from moving out of lock core 253. Thus, after door 70 is opened by operating outer operating device 210, it is required to use key 260 to move lock core 253 from the non-initial position to the initial position to align each lower tumbler pin 253E with the corresponding upper tumbler pin 252E, permitting each pair of upper and lower tumbler pins 252E and 253E aligned with each other to move along the longitudinal axis of aligned upper and lower tumbler pin holes 252D and 253D. Thus, key 260 can be removed out of lock core 253. Furthermore, when lock core pivots from the non-initial position to the initial position, first lug 256A of actuating block 256 presses against protrusion 395 of follower 391, moving follower 391 and movable block 353 from the joint movement position to the disengagement position, such that outer operating device 210 cannot move latch 42.

By using lock core 253 that only permits removal of key 260 when lock core 253 is in the initial position and by incorporating the arrangement of first and second lugs 256A and 256B of actuating block 256, and after door 70 has been opened by operating outer operating device 210, latch device 10 cannot be operated by operating handle 455 if key 260 is removed. This provides advantages when the user forgets to lock door lock 1. Furthermore, the user can judge whether outer operating device 210 is in the locked state by removal of key 260 from lock core 253 without the need of moving handle 455 to open door 70. Furthermore, lock cylinder 251 can include only one upper tumbler pin hole 252D, only one lower tumbler pin hole 253D, and only one setting unit 25.

Now that the basic teachings of the present invention have been explained, many extensions and variations will be obvious to one having ordinary skill in the art. For example, lock cylinder 251 can be mounted to door locks 1 other than the type shown in the drawings. Furthermore, lock cylinder 251 can be utilized with outer operational devices and latch devices of any desired form as conventional including, but not limited to, of a commercially available type. Furthermore, keyway 253C can be simply defined in head 253A.

Thus since the illustrative embodiments disclosed herein may be embodied in other specific forms without departing from the spirit or general characteristics thereof, some of which forms have been indicated, the embodiments described herein are to be considered in all respects illustrative and not restrictive. The scope is to be indicated by the appended claims, rather than by the foregoing description, and all changes which come within the meaning and range of equivalency of the claims are intended to be embraced therein.

The invention claimed is:

1. A lock cylinder for a door lock comprising:

a cylinder body including a lock core hole having a longitudinal axis;

a lock core pivotably received in the lock core hole, with the lock core including a head and a tail, with the lock core further including a keyway defined in the head, with the tail located outside of the cylinder body, with the lock core pivotable about the longitudinal axis of the lock core hole between an initial position and a non-initial position, and with the keyway adapted to receive a key;

a setting unit received in at least one of the cylinder body and the lock core, with the setting unit controllable to move between an engagement position and a release position, and with the key adapted to be inserted into the keyway to move the setting unit from the engagement position to the release position; and an actuating block fixed to the tail of the lock core, with the actuating block including first and second lugs on an outer periphery thereof and spaced from each other in a circumferential direction about the longitudinal axis of the lock core hole, with the first and second lugs adapted to be operatively coupled with a door lock, with the door lock including an outer operational device and a latch device, and with one of the outer operational device and the latch device including a follower located between the first and second lugs, wherein when the lock core is in the initial position and when the setting unit is in the engagement position not receiving the key, the lock core is prevented from pivoting from the initial position to the non-initial position, and the lock core only permits insertion of the key into the keyway or removal of the key out of the keyway, wherein when the lock core is in the initial position and when the setting unit is in the release position receiving the key, the lock core is pivotable from the initial position to the non-initial position, wherein when the key received in the keyway is operated to pivot the lock core from the initial position to the non-initial position, removal of the key out of the keyway is not permitted, wherein when the lock core moves from the non-initial position to the initial position, the second lug of the actuating block is actuates the follower to move in a first direction to a first position to change an operative state of one of the outer operating device and the latch device of the door lock to thereby prevent a latch of the latch device from being moved from a latching position to an unlatching position by operating the outer operating device of the door lock, and wherein when the lock core moves from the initial position to the non-initial position, the first lug of the actuating block actuates the follower to move in a second direction opposite to the first direction to a second position to change the operative state of the one of the outer operating device and the latch device of the door lock to thereby permit the latch to be moved from the latching position to the unlatching position by operating the outer operating device.

2. The lock cylinder for a door lock as claimed in claim 1, with the cylinder body further including an upper tumbler pin hole in communication with the lock core hole, with the lock core further including a lower tumbler pin hole, with the setting unit including an upper tumbler pin received in the upper tumbler pin hole, with the setting unit further including a lower tumbler pin received in the lower tumbler pin hole, with the setting unit further including a spring biasing the upper tumbler pin against the lower tumbler pin, and with the key adapted to be inserted into the keyway to press against the lower tumbler pin to move the setting unit from the engagement position to the release position, wherein when the lock core is in the initial position and when the setting unit is in the engagement position not receiving the key, the lower tumbler pin hole is partially received in the keyway, the upper tumbler pin is located in the upper and lower tumbler pin holes, the lock core is prevented from pivoting from the initial position to the non-initial position, and the lock core only permits insertion of the key into the keyway or removal of the key out of the keyway, and wherein when the key received in the keyway is operated to pivot the lock core from the initial position to the non-initial position, the lower tumbler pin pivots together with the lock core to a position in which the lower tumbler pin is limited by an inner periphery of the lock core hole of the cylinder body and serrations of the key, preventing the key from moving along a longitudinal axis of the lower tumbler pin hole, and removal of the key out of the keyway is not permitted.

3. A door lock comprising:

an outer operating device including a handle;

a latch device including a latch operably connected to the handle, with the latch movable between a latching position and an unlatching position, with movement of the handle causing movement of the latch between the latching position and the unlatching position, with one of the latch device and the outer operating device including a follower, with the follower movable between a first position and a second position, wherein when the follower is in the first position, the latch is prevented from moving from the latching position to the unlatching position by operating the handle of the outer operating device, and wherein when the follower is in the second position, the latch is permitted to move from the latching position to the unlatching position by operating the handle of the outer operating device; and a lock cylinder including:

a cylinder body including a lock core hole having a longitudinal axis;

a lock core pivotably received in the lock core hole, with the lock core including a head and a tail, with the lock core further including a keyway defined in the head, with the tail located outside of the cylinder body, with the lock core pivotable about the longitudinal axis of the lock core hole between an initial position and a non-initial position, and with the keyway adapted to receive a key;

a setting unit received in at least one of the cylinder body and the lock core, with the setting unit controllable to move between an engagement position and a release position, and with the key adapted to be inserted into the keyway to move the setting unit from the engagement position to the release position; and an actuating block fixed to the tail of the lock core, with the actuating block including first and second lugs on an outer periphery thereof and spaced from each other in a circumferential direction about the longitudinal axis of the lock core hole, and with the follower located between the first and second lugs, wherein when the lock core is in the initial position and when the setting unit is in the engagement position not receiving the key, the lock core is prevented from pivoting from the initial position to the non-initial position, and the lock core only permits insertion of the key into the keyway or removal of the key out of the keyway, wherein when the lock core is in the initial position and when the setting unit is in the release position receiving the key, the lock core is pivotable from the initial position to the non-initial position, wherein when the key received in the keyway is operated to pivot the lock core from the initial position to the non-initial position, removal of the key out of the keyway is not permitted, wherein when the lock core moves from the non-initial position to the initial position, the second lug of the actuating block is actuates the follower to move in a first direction to the first position to thereby prevent the latch of the latch device from being moved from the latching position to the unlatching position by operating the handle of the outer operating device, and wherein when the lock core moves from the initial position to the non-initial position, the first lug of the actuating block actuates the follower to move in a second direction opposite to the first direction to the second position to thereby permit the latch to be moved from the latching position to the unlatching position by operating the handle of the outer operating device.

4. The door lock as claimed in claim 3, with the cylinder body further including an upper tumbler pin hole in communication with the lock core hole, with the lock core further including a lower tumbler pin hole, with the setting unit including an upper tumbler pin received in the upper tumbler pin hole, with the setting unit further including a lower tumbler pin received in the lower tumbler pin hole, with the setting unit further including a spring biasing the upper tumbler pin against the lower tumbler pin, and with the key adapted to be inserted into the keyway to press against the lower tumbler pin to move the setting unit from the engagement position to the release position, wherein when the lock core is in the initial position and when the setting unit is in the engagement position not receiving the key, the lower tumbler pin hole is partially received in the keyway, the upper tumbler pin is located in the upper and lower tumbler pin holes, the lock core is prevented from pivoting from the initial position to the non-initial position, and the lock core only permits insertion of the key into the keyway or removal of the key out of the keyway, and wherein when the key received in the keyway is operated to pivot the lock core from the initial position to the non-initial position, the lower tumbler pin pivots together with the lock core to a position in which the lower tumbler pin is limited by an inner periphery of the lock core hole of the cylinder body and serrations of the key, preventing the key from moving along a longitudinal axis of the lower tumbler pin hole, and removal of the key out of the keyway is not permitted.

* * * * *